United States Patent [19]

Craft

[11] 4,329,073

[45] May 11, 1982

[54] SINGLE USE RIBBON CARTRIDGE WITH FRANGIBLE RESISTIVE ELEMENT FOR RESTRAINING THE TAKEUP SPOOL

[75] Inventor: James A. Craft, Lexington, Ky.

[73] Assignee: International Business Machines Corporation, Armonk, N.Y.

[21] Appl. No.: 213,718

[22] Filed: Dec. 8, 1980

[51] Int. Cl.[3] ..... B41J 32/00

[52] U.S. Cl. ..... 400/208; 400/234; 242/199

[58] Field of Search ..... 400/208, 234, 208.1; 242/197-199, 65, 55.19 A; 206/409, 603, 634; 401/82

[56] References Cited

U.S. PATENT DOCUMENTS

| | | | |
|---|---|---|---|
| 459,379 | 9/1891 | Sander | 206/634 |
| 769,928 | 9/1904 | Ziegler | 401/82 |
| 2,717,101 | 9/1955 | Van Handel | 401/82 |
| 2,804,508 | 8/1957 | Mästling et al. | 242/199 |
| 3,011,691 | 12/1961 | McGlynn et al. | 206/603 |
| 3,520,495 | 7/1970 | Sotani | 242/199 |
| 4,010,839 | 3/1977 | Guerrini et al. | 400/234 |
| 4,272,201 | 6/1981 | Steger | 400/234 |

OTHER PUBLICATIONS

Okcnogln, "Ribbon Cartridge", IBM Technical Disclosure Bulletin, vol. 22, No. 9, p. 4120, 2/80.

*Primary Examiner*—William Pieprz

*Attorney, Agent, or Firm*—Laurence R. Letson

[57] ABSTRACT

In ribbon cartridges which are utilized in cooperation with a spacially fixed driving member engageable with a takeup spool at its periphery to feed the ribbon, it is necessary for the takeup spool to translate away from the spacially fixed driving member as the spool accumulates ribbon and the consumed ribbon forms disks of increasing diameter. A frangible portion of the cartridge may be utilized in conjunction with its transverse engagement with an extending axle coaxial with the takeup spool to resist the movement of the takeup spool into the chamber of the cartridge except as is forced by the increasing diameter of the ribbon disk formed on the takeup spool. The frangible section of the cartridge may be formed either during molding operation or as an additional member being added during assembly and will break or tear as the axle of the takeup spool is forced away from the end of the cartridge by the increasing diameter of the ribbon disk and the force of a driving member engaging the ribbon periphery. The frangible web section of the cartridge is sufficiently weakened to prevent structural damage to the ribbon mechanism while at the same time providing sufficient resistance to insure engagement of the exterior of the ribbon disk with the driver.

14 Claims, 7 Drawing Figures

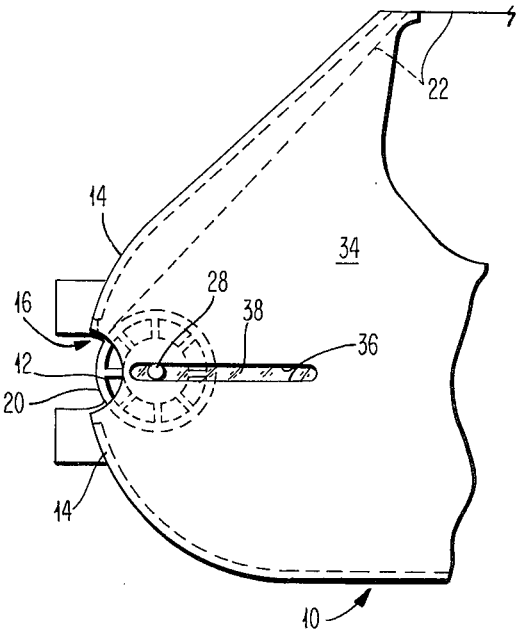
FIG. 5
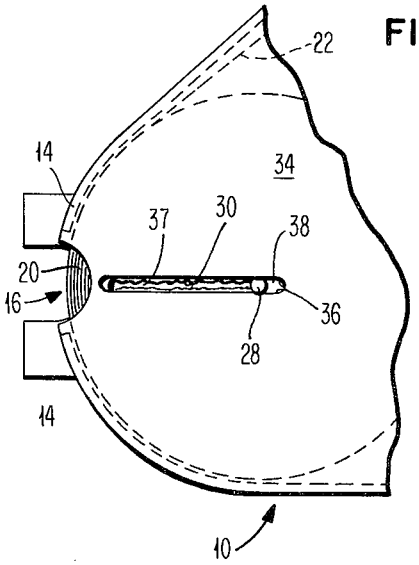
FIG. 6.
FIG. 7
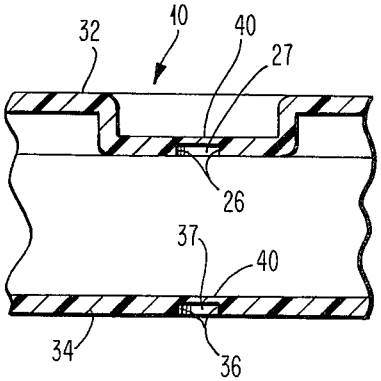

SINGLE USE RIBBON CARTRIDGE WITH FRANGIBLE RESISTIVE ELEMENT FOR RESTRAINING THE TAKEUP SPOOL

RELATED PATENT APPLICATIONS

This application describes an improvement of the cartridge disclosed and claimed in U.S. application Ser. No. 152,207 filed May 22, 1980, U.S. Pat. No. 4,302,118, which is a division of U.S. patent application Ser. No. 801,286 filed May 27, 1977.

BACKGROUND OF THE INVENTION

This invention relates to cartridges for spooled webs and particularly to cartridges for ribbons for use on typewriters and printers.

The manufacture of ribbon cartridges which utilize a translating takeup spool and require springs and spring guides for proper assembly and operation are expensive due, not only to the cost of the parts but also, to the expense of assembly.

The expense of a spring and spring guide is not justified from the standpoint that the spring is a long-term functional element inherently possessing reuse capability. However, the discarding of cartridges after the consumption of the ribbon contained therein wastes the reuse capability of the parts and thus derives no benefit from the increased cost. The reduction of cost in manufacturing and assembly of those aspects of the cartridge which do not require reuse is important both from an economy and the operability standpoint.

OBJECTS OF THE INVENTION

It is an object of the invention to simplify a cartridge having a translating takeup spool to reduce cost.

It is a further object of the invention to reduce mechanical parts, of a cartridge having a translating takeup spool, to the minimum.

It is a further object of the invention to utilize an inexpensive but destructively consumed element of the cartridge to provide resistive bias to a translating takeup spool in a one-time use ribbon cartridge.

The disadvantages of the prior art and the objects of the invention are accomplished by the cartridge structure disclosed herein and may be more fully understood by reference to the drawings and description to follow.

SUMMARY OF THE INVENTION

A resistance is provided to insure the location of a takeup spool such that the periphery of the ribbon disk formed on the takeup spool is proximate to the point at which a driving mechanism may engage the periphery of the takeup spool for winding of consumed ribbon on the takeup spool. This resistance is provided by the engagement of an axle member extending through the center of the takeup spool, coaxially therewith, with the thin web section of the cartridge wall through which the axle member extends.

The thin web section is provided in such relative dimensions as to be sufficiently weak to be broken or torn by the axle as it translates in a direction substantially parallel to the plane of the weak, thin web section and substantially perpendicular to the axis of the axle member.

As the takeup spool is forced to translate due to the increasing diameter of the ribbon disk, the force of the spool on the axle will increase and will continue to increase and create a stress on the web section until such time as the rupture strength of the web section is exceeded. This will create a localized tearing or breaking of the web allowing the axle to translate an incremental amount, thus relieving the forces exerted on the axle until such time as additional ribbon is accumulated on the takeup spool, thus increasing the forces again to exceed the rupture strength.

The rupture strength of the web section need only be that which exceeds the minimum necessary force to insure engagement between the periphery of the ribbon disk and the driver and less than that which will cause feed mechanism failure or breakage.

DRAWING

FIG. 5 is a bottom view of the cartridge as shown in FIG. 1 with a frangible web member resisting the axle of the takeup spool on the bottom side thereof.

FIG. 6 is a bottom view of the cartridge with the takeup spool having accumulated essentially full ribbon disk of consumed ribbon.

FIG. 7 illustrates an alternative embodiment of the frangible web section wherein the web section is formed as an integral part of the cartridge wall structure during molding.

DETAILED DESCRIPTION OF THE INVENTION

Figure 1:
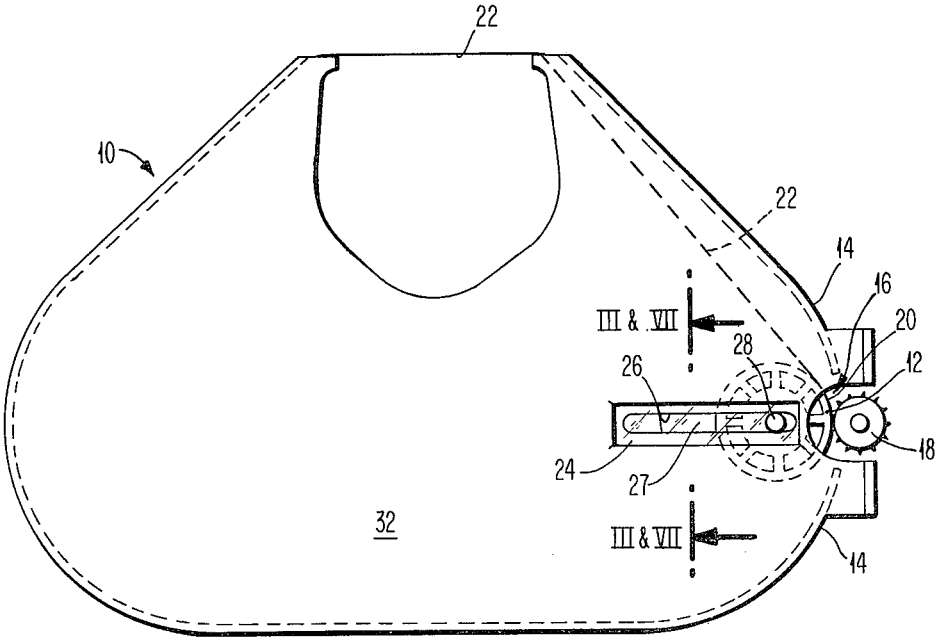
FIG. 1 illustrates the general configuration of a cartridge having a translatory takeup spool together with a frangible web resistance member attached to the top surface thereof.

Referring to FIG. 1, there is illustrated a cartridge 10 having a takeup spool 12 extending outwardly through an opening formed by wall section 14. This exposure of takeup spool 12 through the aperture 16, formed by wall section 14, allows access by drive roller 18 to the periphery of takeup spool 12 or the periphery of the ribbon disk 20 as the ribbon disk diameter grows. Ribbon disk 20 is accumulated and increases in diameter as consumed ribbon 22 is wound onto takeup spool 12 by the action of drive roller 18 rotating thereagainst.

Web member 24 is shown covering the guide surfaces 26 formed in the top wall of cartridge 10. Guide surfaces 26 are conventionally formed during the molding operation by means of inserts in a mold to yield a guide slot 27 through which axle 28 of takeup spool 12 may protrude by a short distance. Axle 28 will extend sufficiently through guide slot 27 to extend beyond and exteriorally of the plane defined by frangible web 24. Frangible web 24 may be provided with an aperture through which axle 28 may be inserted during assembly or may be provided only as a solid sheet with the axle 28 being forcibly pierced therethrough during assembly.

Figure 2:
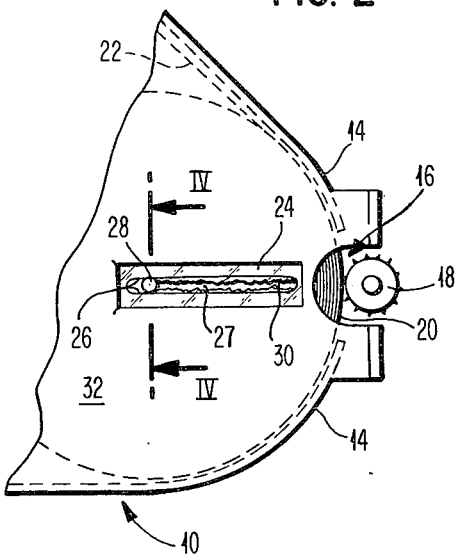
FIG. 2 illustrates the position occupied by the takeup spool axle after having accumulated a substantially full ribbon disk of consumed ribbon.

FIG. 2 is a partial view of the cartridge 10 of FIG. 1 but illustrates frangible web member 24 after axle 28 has translated a substantial portion of its translatory path defined by guide slot 26. Frangible web 24 is ruptured during the translation of axle 28 and the torn edges of web 24 is shown at 30.

Figure 3:
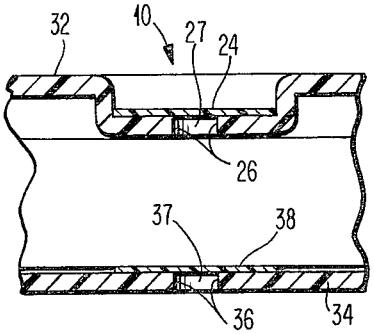
FIG. 3 illustrates the frangible web members in a position mounted on and bonded to the cartridge structure.

FIG. 3 more clearly illustrates the guide slot 27 in the top wall 32 of cartridge 10. Overlaying the portion of the top wall 32 which acts to define guide slot 27 and adhered or sealed thereto is web 24.

Figure 4:
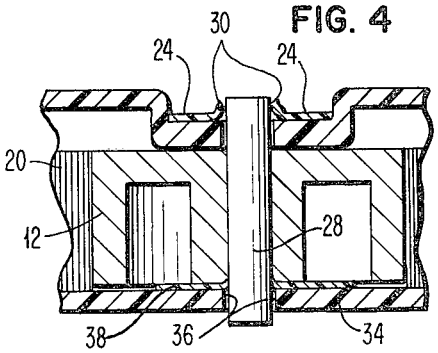
FIG. 4 shows a section along section line IV—IV with an axle of the takeup spool extending therethrough and breaking the frangible webs.

FIG. 4 illustrates the same view of the cartridge as in FIG. 3 with the axle 28 extending through web 24 and shows the torn edges 30 of web 24. Takeup spool 12 is illustrated surrounding axle 28. A substantially identical web is attached and bonded to the bottom wall 34 for the bottom end of axle 28 to engage. A guide slot 37 is formed and defined by guide surfaces 36 of bottom wall 34. This guide slot 37 is functionally identical to the guide slot 27 in the top wall 32 of cartridge 10. In the embodiments illustrated in FIGS. 1–4, the web member 24 may be a thin piece or sheet of material such as polyethylene terathylate or comparable sheet plastic. There appears to be nothing critical in the selection of the material so long as the material is sufficiently resistive to tearing that the resistance exerted, by the material prior to rupture, on axle 28 is enough to insure the positioning of takeup spool 12 so that the periphery of the takeup spool 12 or ribbon disk 20 is proximate to the aperture 16 formed by side walls 14 of cartridge 10. The rupture or tearing strength of the web 24 must also be less than that which would exert a destructive force through axle 28, takeup spool 12 and the periphery 20 of the ribbon disk to the driver 18.

Referring to FIGS. 5 and 6, web 38 is illustrated in two conditions. FIG. 5 illustrates web 38 as undisturbed and with the takeup spool proximate to the exterior opening 16 formed by the side walls 14 of cartridge 10. FIG. 6 is an identical view of the cartridge 10 except for the translation of axle 28 along the guideway 37 leaving web 38 fractured and torn with the torn surfaces 30 illustrated to the left of axle 28.

FIG. 7 illustrates an alternate embodiment of the invention. Cartridge 10 is shown with the top wall 32 and bottom wall 34. Formed into top wall 32 is a channel having guide surfaces 26 formed into the thickness of the top wall 32. The web portion 40 in top wall 32 and in bottom wall 34 is formed by leaving a flash 40, in the molding operation, extending across the guide slots 27, 37 formed by surfaces 26 and 36. This flash or thin and thus weakened wall section 40 will break as axle 28 translates in the guide slots 27, 37 and perform in the same manner as the webs 24 and 38 as illustrated in FIGS. 3 and 4.

While the invention is shown in the foregoing embodiments, changes and modifications may be made by one of skill in the art within the scope of the invention.

I claim:

1. A ribbon cartridge for containing and feeding a single use ribbon comprising a top, bottom and side walls, a supply spool and a takeup spool including an axle, said takeup spool and axle displaceable from a position proximate said side wall to a position displaced from said side wall as said takeup spool accumulates ribbon, restraining means for resisting said takeup spool displacement as forced by said ribbon accumulation, said restraining means comprising a frangible member in said top and bottom walls and engaging said axle, whereby said axle breaks said member progressively as said axle and said takeup spool displaces from said position adjacent said side wall.

2. A cartridge of claim 1 wherein said frangible member comprises a section of said cartridge top and bottom walls of reduced thickness from that of surrounding wall portions.

3. The cartridge of claim 1 wherein said frangible member comprises a sheet of frangible material bonded to each of said top and bottom walls.

4. The cartridge of claim 1 wherein said frangible member is progressively parted by the tearing action of said axle as said axle is displaced due to increased diameter of said takeup spool as said spool accumulates ribbon thereon.

5. The cartridge of claim 1 wherein said top and bottom walls form guide slots for constraining said axle to a linear path.

6. A ribbon cartridge having walls and a chamber therein, separate takeup and supply spools and a ribbon extending therebetween, said takeup spool having an axle extending outward through said walls of said cartridge; means acting to resist translatory movement of said takeup spool, said means acting to resist movement comprising a frangible wall section engaging said axle and progressively yieldable to said axle as said takeup spool and axle translate.

7. The cartridge of claim 6 wherein said top and bottom wall sections define guide slots to define a translatory path for said axle.

8. The ribbon cartridge of claim 7 wherein said frangible wall section is a closure extending across said guide slots and engaging said axle.

9. The ribbon cartridge of claim 8 further comprising a ribbon wound upon said supply spool and extending exteriorily of said chamber to said takeup spool to be wound thereon to form a ribbon disk.

10. The ribbon cartridge of claim 9 wherein said ribbon accumulation on said takeup spool, in building the diameter of said ribbon disk, forces said takeup spool along said guide slots and thereby rends said frangible wall section.

11. A combination for restricting the translation of a takeup spool in a chamber defined by walls of a cartridge, said chamber defining an access aperture in the wall thereof, comprising:

an axle extending axially of said takeup spool;

a frangible web engaging said axle in a plane transverse to said axle whereby resistance to translatory motion of said takeup spool is exerted on said axle by said web, to the extent necessary to progressively tear said web.

12. The combination of claim 11 further including ribbon progressively accumulated on said takeup spool to form a ribbon disk and thereby increasing the diameter of said ribbon disk, said frangible web resistive to translation of said axle to insure constant location of the periphery of said disk with respect to said cartridge portion defining said access aperture.

13. The combination of claim 12 wherein said access aperture is positioned adjacent the position of said takeup spool ribbon disk, thereby affording driving access to said ribbon disk.

14. A typewriter ribbon cartridge comprising: a ribbon web, a top wall, bottom wall, side walls, and a pair of openings in said side walls, said openings permitting the exiting and entrance of said ribbon web through said openings to provide a span of said ribbon web exterior to said cartridge, a takeup spool, a supply spool, said ribbon web attached to said takeup spool and supply spool, said takeup spool comprising an axle extending through said top and bottom walls, said takeup spool contained within said cartridge and adjacent one side wall of said cartridge, a third opening in said side wall adjacent to said takeup spool for providing access to the periphery of said takeup spool, said top and bottom walls of said cartridge comprising a thin weakened frangible section formed therein and having said axle of said takeup spool extending through a portion thereof, said frangible section of said top and bottom walls oriented along a line perpendicular to the tangent of said takeup spool at the point where said takeup spool intersects the opening in said wall section whereby, as said takeup spool increases in diameter by taking up consumed ribbon, said axle will act to progressively fracture said frangible section of said top and bottom walls of said cartridge.

* * * * *